US008370978B2

(12) United States Patent
Duvert

(10) Patent No.: US 8,370,978 B2
(45) Date of Patent: Feb. 12, 2013

(54) HOSPITAL BED EQUIPPED WITH A PATIENT MOBILITY AID DEVICE

(75) Inventor: Jean-Bernard Duvert, Auray (FR)

(73) Assignee: Hill-Rom S.A.S., Pluvigner (FR)

( * ) Notice: Subject to any disclaimer, the term of this patent is extended or adjusted under 35 U.S.C. 154(b) by 293 days.

(21) Appl. No.: 12/834,955

(22) Filed: Jul. 13, 2010

(65) Prior Publication Data

US 2011/0010864 A1 Jan. 20, 2011

Related U.S. Application Data

(60) Provisional application No. 61/226,486, filed on Jul. 17, 2009.

(30) Foreign Application Priority Data

Jan. 18, 2010 (FR) ..... 10 50299

(51) Int. Cl.
*A47C 31/00* (2006.01)

(52) U.S. Cl. ..... 5/662; 5/428; 5/621

(58) Field of Classification Search ..... 5/621, 623, 5/646, 424, 425, 427–430, 662, 203, 226, 5/282.1, 285, 305
See application file for complete search history.

(56) References Cited

U.S. PATENT DOCUMENTS

| | | | | |
|---|---|---|---|---|
| 2,585,660 | A | 2/1952 | Kjos et al. | |
| 3,312,986 | A | 4/1967 | Fahrni et al. | |
| 3,905,591 | A * | 9/1975 | Schorr et al. | 5/601 |
| 4,251,105 | A | 2/1981 | Barker | |
| 4,277,100 | A | 7/1981 | Beougher | |
| 4,932,090 | A | 6/1990 | Johansson | |
| 4,941,708 | A | 7/1990 | Heffner | |
| 5,038,430 | A * | 8/1991 | Bly | 5/425 |
| 5,060,327 | A * | 10/1991 | Celestina et al. | 5/662 |
| 5,195,200 | A | 3/1993 | Leoutsakos | |
| D336,578 | S | 6/1993 | Celestina | |
| 5,231,721 | A | 8/1993 | Fish | |
| 5,257,426 | A | 11/1993 | Leoutsakos | |
| 5,335,385 | A | 8/1994 | Brown | |
| 5,337,430 | A | 8/1994 | Schlein | |
| 5,384,927 | A | 1/1995 | Mardero et al. | |
| 5,394,581 | A | 3/1995 | Leoutsakos | |
| 5,586,352 | A | 12/1996 | O'Brien et al. | |
| 5,678,267 | A | 10/1997 | Kinder | |
| 5,839,136 | A | 11/1998 | Vance et al. | |

(Continued)

FOREIGN PATENT DOCUMENTS

| | | |
|---|---|---|
| DE | 297 09 508 U1 | 8/1997 |
| DE | 19825344 A1 | 12/1999 |

(Continued)

OTHER PUBLICATIONS

European search report from EP 10 25 1243 dated Jan. 28, 2011, 7 pages.

*Primary Examiner* — Robert G Santos
*Assistant Examiner* — Nicholas Polito
(74) *Attorney, Agent, or Firm* — Barnes & Thornburg LLP

(57) ABSTRACT

A hospital bed is equipped with a patient mobility aid device having at least one adjustable lateral grip that aids the patient in performing certain movements such as entering or exiting the bed. The patient mobility aid device includes a support crossmember having a length oriented along a width of the bed. Couplers at the ends of the crossmember attach to frame elements of the bed. The crossmember houses at least one arm to which the adjustable lateral grip is coupled. The at least one arm extends and retracts with respect to the crossmember.

16 Claims, 5 Drawing Sheets

U.S. PATENT DOCUMENTS

| | | | | |
|---|---|---|---|---|
| 5,978,992 | A | 11/1999 | Antinori | |
| 6,058,531 | A | 5/2000 | Carroll | |
| 6,134,731 | A | 10/2000 | Thom et al. | |
| 6,138,301 | A | 10/2000 | Battison | |
| 6,167,895 | B1 | 1/2001 | Burroughs | |
| 6,209,155 | B1 * | 4/2001 | Epstein et al. | 5/201 |
| 6,240,583 | B1 | 6/2001 | Brooke et al. | |
| D458,481 | S | 6/2002 | Brooke | |
| D459,119 | S | 6/2002 | Brooke | |
| 6,397,416 | B2 | 6/2002 | Brooke et al. | |
| 6,728,985 | B2 | 5/2004 | Brooke et al. | |
| D520,783 | S | 5/2006 | Freeborn et al. | |
| 7,039,971 | B2 | 5/2006 | Sebastien | |
| 7,150,058 | B2 | 12/2006 | Rabska et al. | |
| D535,544 | S | 1/2007 | DeBraal et al. | |
| 7,797,775 | B2 | 9/2010 | Miller | |
| 7,805,789 | B1 | 10/2010 | Dean | |
| 8,239,986 | B2 * | 8/2012 | Heimbrock et al. | 5/430 |
| 2002/0116760 | A1 | 8/2002 | Foster et al. | |
| 2006/0195984 | A1 | 9/2006 | Hakamiun | |

FOREIGN PATENT DOCUMENTS

| | | | |
|---|---|---|---|
| EP | 0 756 857 | A2 | 2/1997 |
| WO | WO 82/02832 | | 9/1982 |
| WO | WO 03/075816 | A2 | 9/2003 |
| WO | 2006/058506 | A1 | 6/2006 |

* cited by examiner

HOSPITAL BED EQUIPPED WITH A PATIENT MOBILITY AID DEVICE

CROSS-REFERENCE TO RELATED APPLICATIONS

The present application claims priority, under 35 U.S.C. §119(a), of French National Application No. 1050299 which was filed Jan. 18, 2010 and the present application also claims the benefit, under 35 U.S.C. §119(e), of U.S. Provisional Application No. 61/226,486 which was filed Jul. 17, 2009, both of which are hereby incorporated by reference herein.

BACKGROUND

The present disclosure relates to a hospital bed equipped with a patient mobility aid device, and more particularly concerns a subassembly adaptable to the bed, fitted with retractable lateral grips to allow the patient to sit up or lie down in the bed, and possibly to get in and out thereof if the patient's condition allows it.

Different types of hospital beds are known, generally equipped with side barriers hinged to the upper chassis and collapsible along said chassis in order to completely secure the patient by eliminating any risk of falling. For the comfort of the patient, the sleeping surface includes several portions hinged to one another along transversal axes. In particular, a head frame and foot frame, hinged on either side of a central portion (which itself can be subdivided) can be distinguished. In the convalescence phase, it is desirable for the patient to be able to sit up or lie down with the aid of lateral grips, the side barriers being lowered.

SUMMARY

According to aspects of this disclosure, a subassembly that allows lateral grips to be coupled to a bed is provided. According to some embodiments contemplated herein, said grips may be retractable at the level of the sleeping surface, and may be located, when deployed, above the plane of the sleeping surface and slightly outside thereof. The illustrated embodiment achieves this aspect of the disclosure.

More particularly, embodiments contemplated herein concern a hospital bed equipped with a patient mobility aid device, characterized in that said device may comprise a support crossmember of a length oriented along the width of said bed, provided at each of its ends with an attachment means shaped and sized to be attached to a lateral element of said bed, in that said crossmember may be hollow and houses at least one arm terminating in a grip, and in that said arm may define with the crossmember a telescopic structure such that said grip can be moved to a usage position situated above and outside the edge of the bed from its storage position in the vicinity of the respective end of said crossmember.

According to some embodiments, one or more stable positions of the grip may be defined between the storage position and a position where it is extended out to the maximum. It is also possible simply to have two positions, a storage position and a usage position.

In some embodiments, the mobility aid device may be equipped with two arms, each with a grip at the end, projecting from each end of said crossmember.

According to some embodiments, the device is characterized in that said crossmember comprises a middle section and two guide end fittings respectively disposed at the ends of said middle section and in that an attachment means as mentioned above is composed of a U-shaped bracket defined in such guide end fitting, opening laterally outward, the height of said bracket corresponding to the thickness of a longitudinal element of a frame of said bed, so that said crossmember is mounted between two such longitudinal elements that are parallel to said frame.

According to some embodiments, the device may be further characterized in that the arm or each arm is curved and in that each guide end fitting comprises internally a guide channel ascending overall, in which the arm slides, said channel extending between an aperture of said end fitting engaged at the corresponding end of said middle section and an upper outlet defined above said attachment means.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
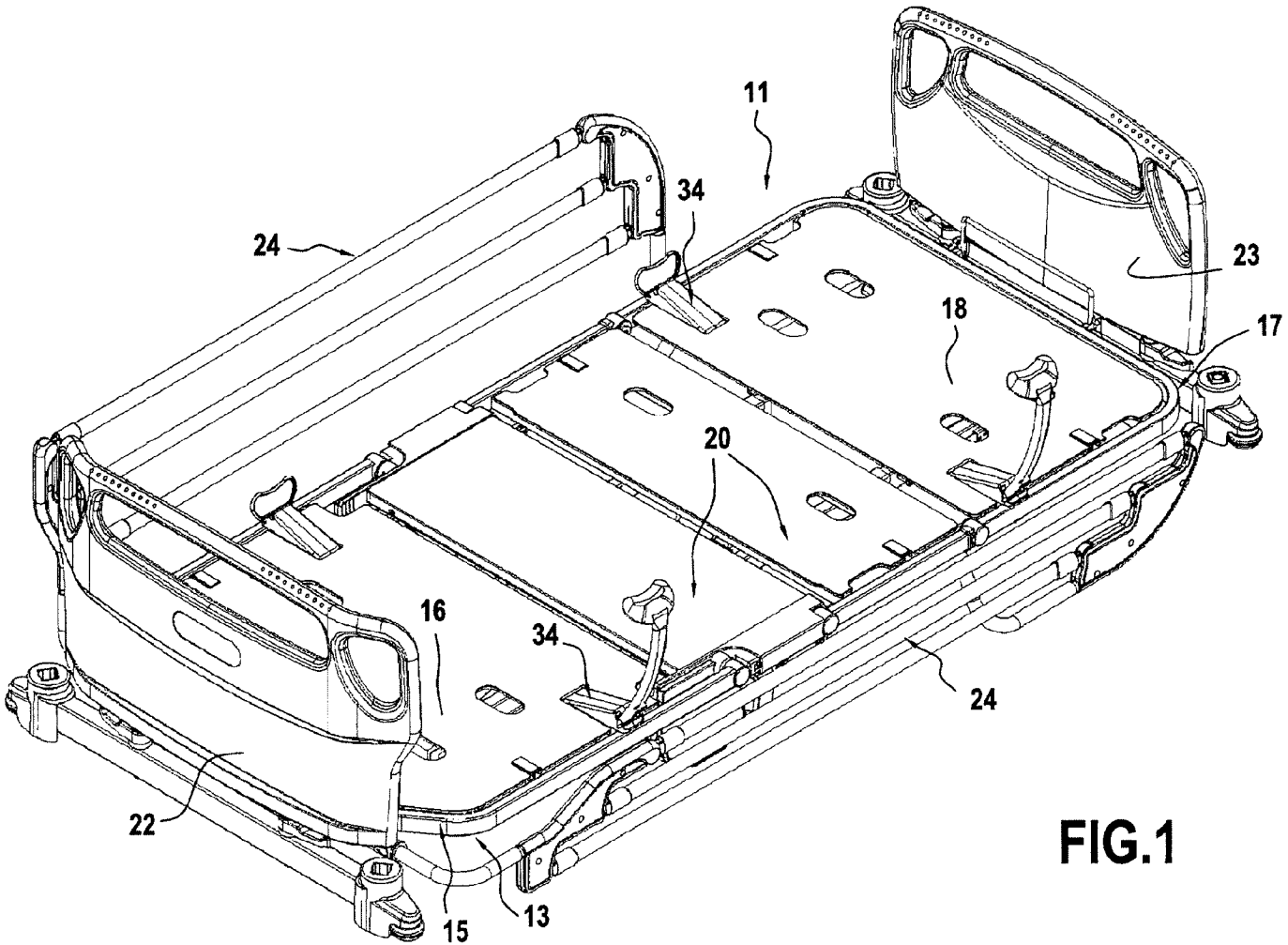
FIG. 1 is a general view in perspective of a hospital bed equipped with two patient mobility aid devices, one attached to the head frame and the other attached to the foot frame of the sleeping surface.
Figure 2:
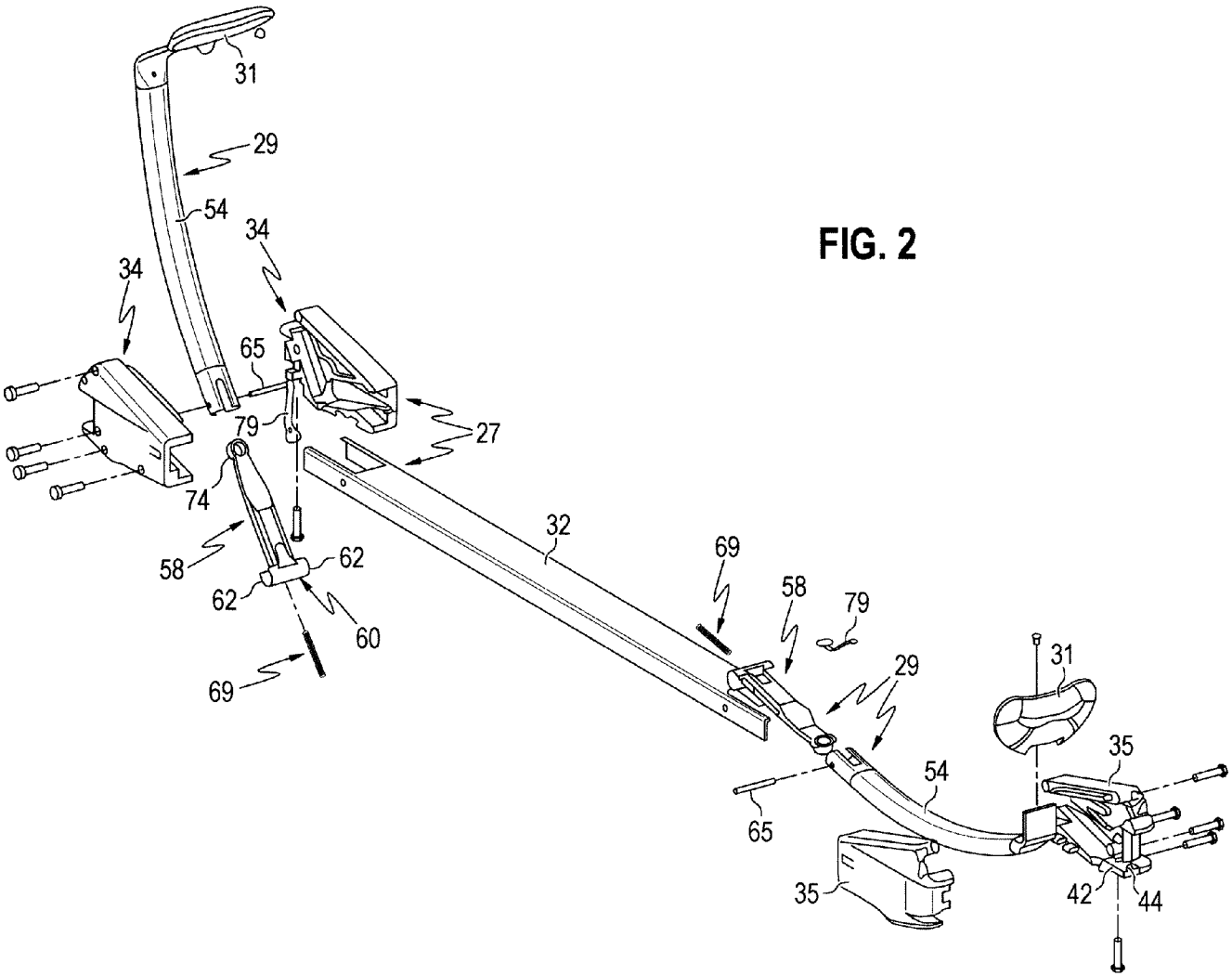
FIG. 2 is an exploded view in perspective of such a patient mobility aid device.

With reference to the drawings, represented is a hospital bed 11 comprising, in the illustrated embodiment, an upper chassis 13 forming the sleeping surface, intended to receive a mattress, not shown. The upper chassis comprises, in the illustrated embodiment, a head frame 15 covered by a panel 16 and a foot frame 17 covered by a panel 18. The two frames are hinged on either side of a central part 20 (which itself includes two panels). The bed is also equipped with a headboard 22, a footboard 23 and two side barriers 24, collapsible at the lower part of the upper chassis 13. The two frames 15 and 17 can therefore be raised by hinged pivoting on either side of the central part 20.

According to an aspect of the disclosed embodiment, the bed 11 is equipped with at least one (in this instance, two) patient mobility aid device 25 (see FIG. 3), enabling said patient to perform certain movements, particularly to sit up or lie down, or even to get in and out of bed if the patient is able to do so.

According to the illustrated example, one of the devices 25 is attached to the head frame 15 and the other is attached to the foot frame 17.

Each device 25 comprises a support crossmember 27 of a length corresponding to (i.e., oriented along) the width of the bed 11 and at least one arm 29 (preferably two) ending in a grip 31. The crossmember is hollow in order to house the arm 29 or each arm 29 when the grip is in the stored position. In other words, each arm 29 defines with the crossmember 27 a telescopic structure such that the corresponding grip 31 can be moved to a usage position situated above and outside the edge of the bed 11 from its storage position near the respective end of the crossmember 27.

According to the illustrated example, the device 25 is equipped with two arms 29, each ending in a grip 31, projecting at one respective end of the crossmember 27.

More specifically, the crossmember 27 comprises a rectilinear middle section 32 formed from a rail-type C-shaped metal structural shape, the open side facing the floor, and two guide end fittings 34 disposed at the ends of said middle section 32. Each guide end fitting 34 is here composed of two shells 35, symmetrical overall, made of plastic material, assembled by screws, to fit tightly around each end of said middle section 32 and extend it. The end fittings 34 are mounted on the ends of the middle section 32 and attached thereto.

The support crossmember 27 thus constructed is fitted at each of its ends with an attachment means or coupler shaped and sized to be attached to a side element of said bed 11, in this instance a frame of the chassis. More specifically, the crossmember 27 is mounted between two parallel longitudinal elements 37 of the head frame 15 or the foot frame 17. Thus, the crossmember 27 can be mounted perpendicular to the longitudinal dimension of the bed between these two parallel longitudinal elements 37 of the frame 15 or 17.

In the example described, each guide end fitting 34 comprises one such coupler or attachment means that is composed of a U-shaped bracket 40, opening laterally outward.

The height of the opening of the bracket 40 generally corresponds to the thickness of the longitudinal element 37. At least one arm of the bracket 40, for example an arm 42 attached by screws to the lower part of the end fitting 34, is sufficiently flexible to allow a clamped fitting of the bracket 40 onto the element 37 in spite of the presence on this arm 42 of a spur 44. Said spur 44 is capable of cooperating with a corresponding hole 46 (see FIG. 5) in the longitudinal element 37, for attaching the assembly of said patient mobility aid device to the bed frame.

Figure 5:
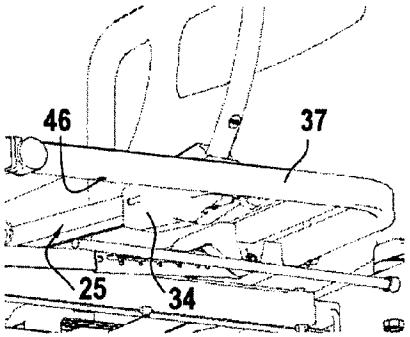
Figure 4:
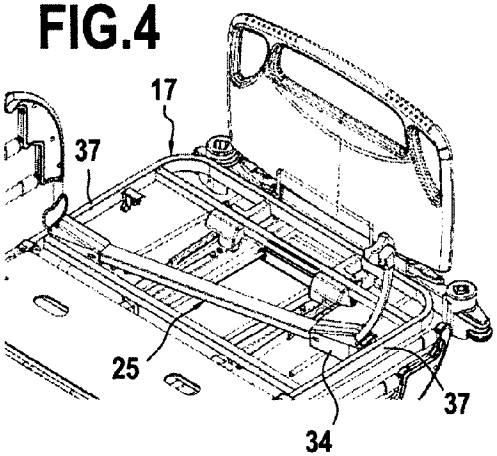

For example, FIGS. 4 to 8 illustrate the assembly and attachment of the device 25 to the foot frame 17. Said assembly is begun by raising the panel 18, then the crossmember 27 is fitted at an angle, the two brackets 40 being fitted between the elements 37 (FIGS. 4 and 5).

Figure 7:
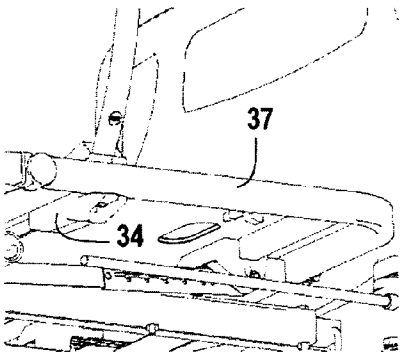
Figure 6:
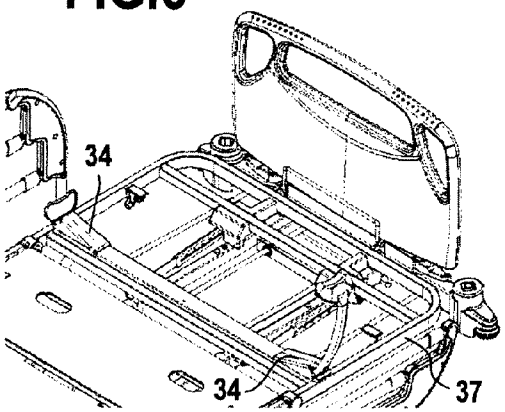

FIG. 5 shows the hole 46 of one of the elements 37, at the lower part thereof. Then, as shown in FIGS. 6 and 7, the device 25 is pivoted in its entirety until the spur 44 of each bracket is inserted in the respective hole. Finally, the panel 18 is put back in place (see FIG. 8), said panel 18 having cutouts allowing the passage of the end portions of the guide end fittings 34 on either side of the bed 11. It will be noted that when a side barrier 24 is raised, the arm 29 of the device situated on the same side cannot be raised in the illustrated embodiment.

According to the illustrated embodiment, each arm 29 is curved, and the curved part, excluding the grip 31, can be fully housed (see FIG. 3, right side) inside the middle section 32 and the respective end fitting 34.

To accomplish this, each guide end fitting 34 comprises internally a guide channel 47, ascending overall, in which the arm 29 is partially housed and slides. The channel 47 extends between an aperture 49 of said end fitting 34 engaged at the corresponding end of said middle section 32 and an upper outlet 51 defined above said attachment means, i.e. the bracket 40.

The relatively flexible plastic material of the end fitting 34 makes it possible to stabilize the position of the grip 31 by elastic forced insertion into the end fitting 34. More precisely, said end fitting 34 comprises, in some embodiments, an elastic insertion indentation 48 of the grip 31, defined in the vicinity of said upper outlet 51 of the guide channel, for the immobilization of said grip 31 in the storage position.

Figure 3:
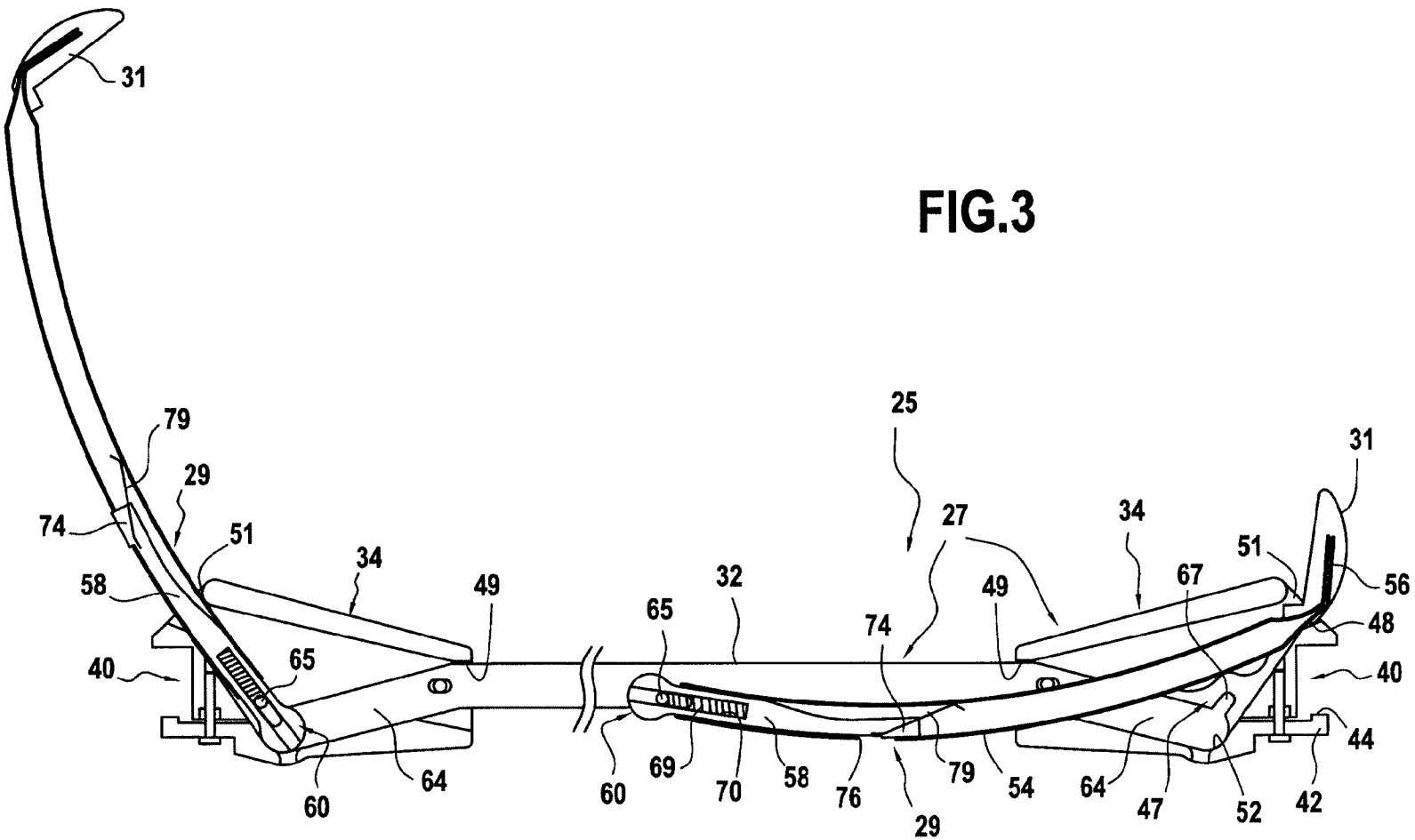
FIG. 3 is a transversal diagrammatic view illustrating the kinetics of the device, the grip being shown in the storage position on the right side and in the usage position on the left side.
Figure 8:
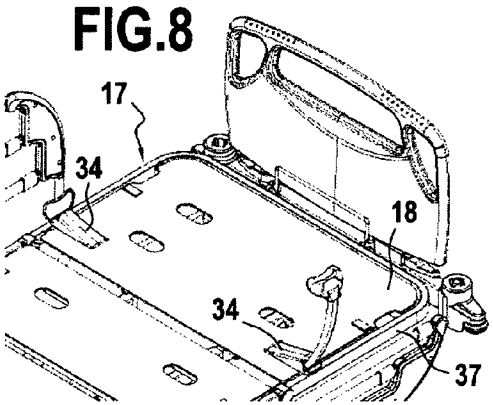
FIGS. 4-8 are partial views, in perspective, showing the installation of a patient mobility aid device on the bed of FIG. 1.

It should be noted that each guide channel 47 comprises a lower wall with a very wide V-shaped opening defining a concave bottom 52 in which, as will be seen below, the lower end of the arm is supported and stabilized in the usage position (see FIG. 3, left part).

Each arm 29 comprises a curved tubular section 54 one end 56 (upper) of which is flat for attaching the grip 31. Said grip always projects out of the upper outlet 51 of the end fitting 34 in the illustrated example.

A locking lever 58 is slidably engaged inside the other end of the tubular section 54. It comprises a round end 60 forming a sort of ball-and-socket joint and projecting from the tubular section 54. This round end 60 comprises two lateral extensions 62 engaging with indentations 64 defined along the inner walls of the guide channel 47. The tubular section 54 is also provided, in the vicinity of this end, with a transversal pin 65 that also engages with said indentations 64. These indentations 64 are such that, when the arm 29 is pulled upward, the round end 60 of the lever penetrates into the end fitting 34 and reaches the above-mentioned concave bottom 52 of the guide channel 47. In the same path, each end of the pin 65 finds a clearance in a narrower ascending extension 67 of each indentation 64. Said extensions 67 have closed upper ends that constitute stops for the pin 65.

A coil spring 69 is installed in a cavity 70 of the lever 58. It is inserted between the pin 65 and the bottom of said cavity 70, in order to push said lever 58 towards the interior of the curved tubular section 54, as can be seen in FIG. 3, right portion. Furthermore, the inner end of the lever 58, engaged in the tubular section 54, is provided with a lateral push button 74. The tubular section 54 is provided with a hole 76 located in the vicinity of the push button 74 (to the left of the push button 74 in the right portion of FIG. 3) and a leaf spring 79 is attached to the push button 74 and is in sliding contact with the inner wall of the curved tubular section 54. Thus, said push button 74 is pushed to engage in the hole 76 when it reaches a position facing said hole 76 if a relative movement is produced between the lever 58 and the curved section 54. The operation is as follows:

When it is desired to use the patient mobility aid device, the grip 31 is taken out and pulled upward and outward. At first, the arm assembly slides in the guide cavity 70, pulling the lever 58. Toward the end of the path, the rounded end 60 is guided by the indentations 64 and the arm stands up. At the end of the path, the ends of the pin 65 engage in the extensions 67 of the indentations, which results in the compression of the spring 69 and thus by a relative movement between the curved tubular section 54 and the lever 58. This movement causes the engagement of the push button 74 (forming a lock) in the hole 76. As of this moment, the situation is as it is represented in FIG. 3, left side, where the slightly extended arm 29, now of a fixed length, is held in the standing position by a wedging effect between the bottom 52 and the upper outlet 51. To return the arm 29 and its grip to the storage position, the push button 79 is pushed to make it enter the curved tubular section 54 while pushing down on the grip 31.

It should be noted that, because each patient mobility aid device 25 is mounted on a pivoting frame 15, 17 of adjustable pitch, the positioning of the frame (its pitch) makes it possible to adjust the position of the grip (height) depending on the morphology of the patient.

Figure 9:
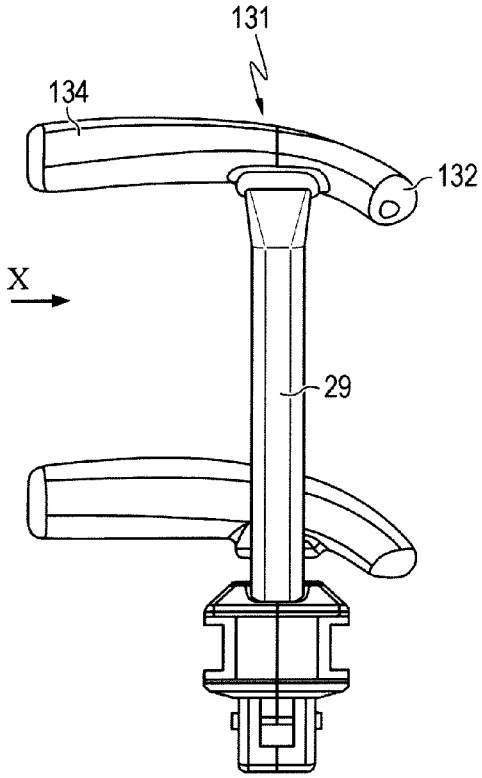
FIG. 9 is a detailed view in perspective showing a variation of the grip.
Figure 10:
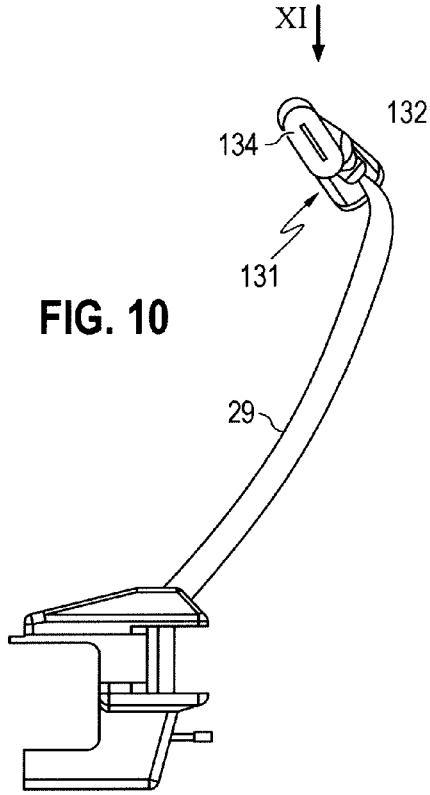
FIG. 10 is a view from the perspective of the arrow X of FIG. 9.
Figure 11:
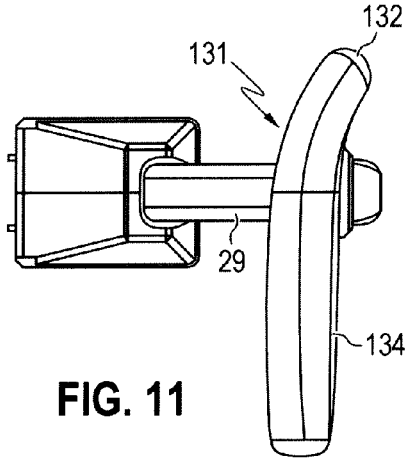
FIG. 11 is a view from the perspective of the arrow XI of FIG. 10.

According to one variation, represented in FIGS. 9 to 11, the grip 131 comprises, at one side of its point of attachment to said arm 29, a curved handle 132 extending beyond said point of attachment, to facilitate gripping in the sit-up phase of the patient. The handle 132 here is curved downward. Moreover, said grip 131 is extended on the other side of the point of attachment to the arm 29 by a helical segment 134 of oblong cross section facilitating thrust in the final phase of the patient's sitting upright, while opposing the grip reflex. These two features are independent, in particular the helical segment 134 can constitute the main part of said grip 131 with or without handle 132, which, if there is one, can have a different shape.

Although certain illustrative embodiments have been described in detail above, many embodiments, variations and modifications are possible that are still within the scope and spirit of this disclosure as described herein and as defined in the following claims.

The invention claimed is:

1. A patient mobility aid device for a hospital bed, the patient mobility aid device comprising a support crossmember having a length oriented along a width of said bed, provided at each of its ends with a coupler configured to be attached to a frame element of said bed, in that said crossmember is hollow and houses at least one arm terminating in a grip, and in that said arm defines with the crossmember a telescopic structure such that said grip can be moved to a usable position situated above and outside the edge of the bed from its storage position in the vicinity of the respective end of said crossmember, wherein the at least one arm comprises two arms, each with a grip, at the end, projecting from each end of said support crossmember, wherein said crossmember comprises a middle section and two guide end fittings respectively disposed at the ends of said middle section and wherein said coupler comprises a U-shaped bracket defined in such guide end fitting, opening laterally outward, the height of an opening of said U-shaped bracket corresponding generally to the thickness of the frame element of said bed, so that said crossmember is mounted between two such frame elements that are parallel, and wherein each arm is curved and wherein each guide end fitting comprises internally a guide channel ascending overall, in which the respective arm slides, each said channel extending between an aperture of said respective end fitting engaged at the corresponding end of said middle section and an upper outlet defined above the respective coupler.

2. The patient mobility aid device of claim 1, wherein at least one arm of said U-shaped bracket is flexible and includes a spur cooperating with a corresponding hole in said frame element, for attaching said mobility aid device to said hospital bed.

3. The patient mobility aid device of claim 1, wherein each said curved arm has a curved tubular section one end of which carries the respective grip projecting out of said upper outlet of the end fitting, wherein each said curved arm has a locking lever slidably engaged inside the other end of said tubular section, wherein each lever has a round end projecting from the respective tubular section and is provided with lateral extensions engaging with indentations defined along the inner walls of said guide channel, wherein each said tubular section is equipped, in the vicinity of said other end, with a transversal pin that engages with said indentations, wherein a first spring is installed in a cavity of each respective lever and is inserted between said respective pin and a bottom of said respective cavity, in order to push said respective lever towards the interior of said curved tubular section, wherein the inner end of each said lever is provided with a lateral push button forming a lock, wherein each said tubular section is provided with a hole located in the vicinity of the push button, and wherein a second spring is attached to said respective push button and is in sliding contact with the inner wall of said respective curved tubular section in order to push each said push button to engage in said respective hole when each said push button reaches a position facing said respective hole.

4. The patient mobility aid device of claim 1, wherein said end fittings each comprise an elastic insertion indentation of the grip, defined in the vicinity of said respective upper outlet of the guide channel, for the immobilization of each said grip in the storage position.

5. The patient mobility aid device of claim 1, wherein the coupler attaches to a pivoting section of said bed frame making it possible to adjust the position of the grip depending on the morphology of the patient.

6. The patient mobility aid device of claim 1, wherein said grip includes a helical segment of oblong cross section.

7. The patient mobility aid device of claim 1, wherein said grip includes a curved handle.

8. A patient mobility aid device for a hospital bed, the patient mobility aid device comprising a crossmember coupled to a frame of the hospital bed such that a length of the cross member is oriented along a width of the hospital bed, a first arm coupled to the crossmember for extension and retraction relative to a first end of the crossmember, a first grip coupled to an end of the first arm, a second arm coupled to the crossmember for extension and retraction relative to a second end of the crossmember, and a second grip coupled to an end of the second arm, wherein each of the first and second arms are curved such that the grips move along an arcuate path during extension and retraction of the first and second arms relative to the crossmember.

9. The patient mobility aid device of claim 8, wherein the crossmember includes a central section and a pair of end fittings located at each end of the central section, each of the first and second arms has a curved tubular section a first end of which carries the respective grip.

10. The patient mobility aid device of claim 9, wherein each said curved arm has a locking lever slidably engaged inside a second end of the respective tubular section.

11. The patient mobility aid device of claim 10, wherein each lever has a round end projecting from the respective tubular section and is provided with lateral extensions that engage with indentations defined along inner walls of respective guide channels formed in the pair of end fittings.

12. The patient mobility aid device of claim 10, wherein each lever is provided with lateral extensions that engage with indentations defined along inner walls of respective guide channels formed in the pair of end fittings.

13. The patient mobility aid device of claim 12, wherein the lateral extensions of each lever are provided by a respective pin, wherein a first spring is installed in a cavity of each respective lever and is inserted between the respective pin and a bottom of said respective cavity, in order to push said respective lever towards the interior of said respective curved tubular section.

14. The patient mobility aid device of claim 13, wherein the inner end of each said lever is provided with a lateral push button forming a lock, wherein each said tubular section is provided with a hole located in the vicinity of the push button, and wherein a second spring is attached to said respective push button and is in sliding contact with the inner wall of said respective curved tubular section in order to push each said push button to engage in said respective hole when each said push button reaches a position facing said respective hole.

15. The patient mobility aid device of claim 8, wherein the first and second grips each include a helical segment of oblong cross section.

16. The patient mobility aid device of claim 8, wherein the first and second grips each includes a curved handle.

* * * * *